US006089376A

United States Patent [19]

Petit et al.

[11] Patent Number: 6,089,376

[45] Date of Patent: Jul. 18, 2000

[54] MAKEUP BOX WITH A SOLID BOTTOM

[75] Inventors: Robert Petit, Chevilly Larue; Alain Behar, Suresnes, both of France

[73] Assignee: Lir France, Chevilly Larue, France

[21] Appl. No.: 09/359,352

[22] Filed: Jul. 21, 1999

[30] Foreign Application Priority Data

Jul. 21, 1998 [FR] France ..... 98 09269

[51] Int. Cl.[7] ..... B65D 69/00; A45D 33/00

[52] U.S. Cl. ..... 206/581; 206/823; 132/293

[58] Field of Search ..... 206/581, 235, 206/37, 38, 823; 132/286, 293, 294; 220/326

[56] References Cited

U.S. PATENT DOCUMENTS

| | | | |
|---|---|---|---|
| 4,429,798 | 2/1984 | Borows . | |
| 4,685,558 | 8/1987 | Filiz et al. | 206/581 |
| 4,989,622 | 2/1991 | Kozuka et al. | 132/293 |
| 5,460,288 | 10/1995 | Balzeau | 220/326 |
| 5,704,378 | 1/1998 | Machelett | 206/823 |
| 5,896,866 | 4/1999 | Quennessen | 206/823 |
| 5,908,037 | 6/1999 | Pierson | 132/293 |
| 5,909,738 | 6/1999 | Quennessen | 132/293 |

FOREIGN PATENT DOCUMENTS

| | | |
|---|---|---|
| 2 610 802 | 8/1988 | France . |
| 20 40 196 | 2/1972 | Germany . |
| 21 03 128 | 9/1972 | Germany . |
| 86 05 195 | 4/1986 | Germany . |

*Primary Examiner*—Jacob K. Ackun
*Assistant Examiner*—Luan K. Bui
*Attorney, Agent, or Firm*—Young & Thompson

[57] ABSTRACT

A makeup box comprising a bottom (1) on which is articulated a cover, a push button being mounted in the periphery of the bottom (1) opposite the axis of articulation of the cover and coacting with a catch or the like of the cover. The bottom (1) is constituted by a solid piece provided with a recess (3) running about all its internal periphery and opening (5) centrally, a front window (6) opening into the recess (3) for the reception of a push button and catches, such as ribs or tongues (8), for the push button, disposed on opposite sides of the window (6).

3 Claims, 2 Drawing Sheets

FIG. 1
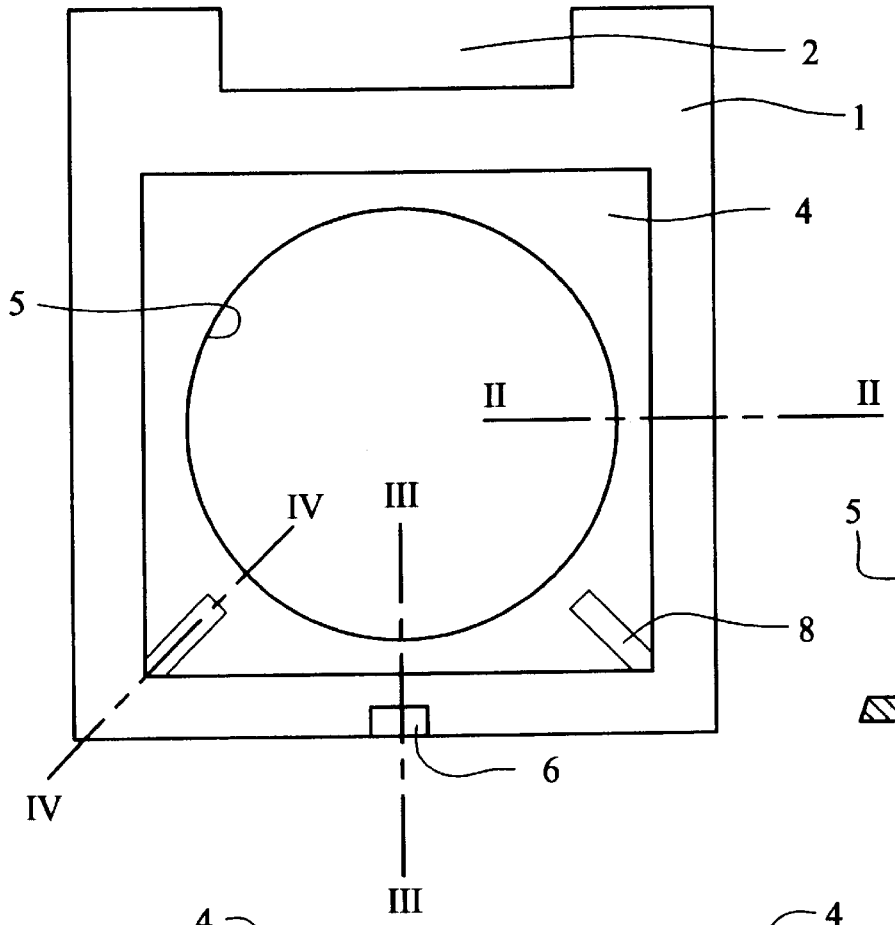
FIG. 2
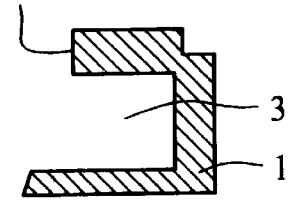
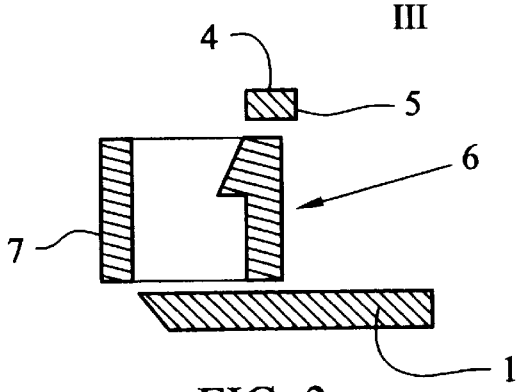
FIG. 3
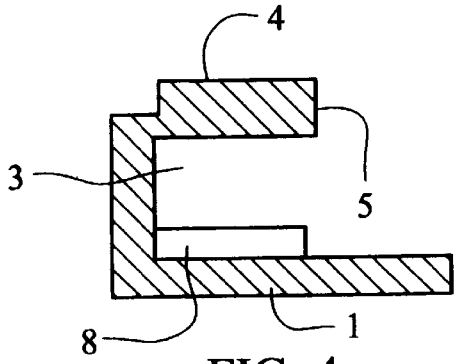
FIG. 4

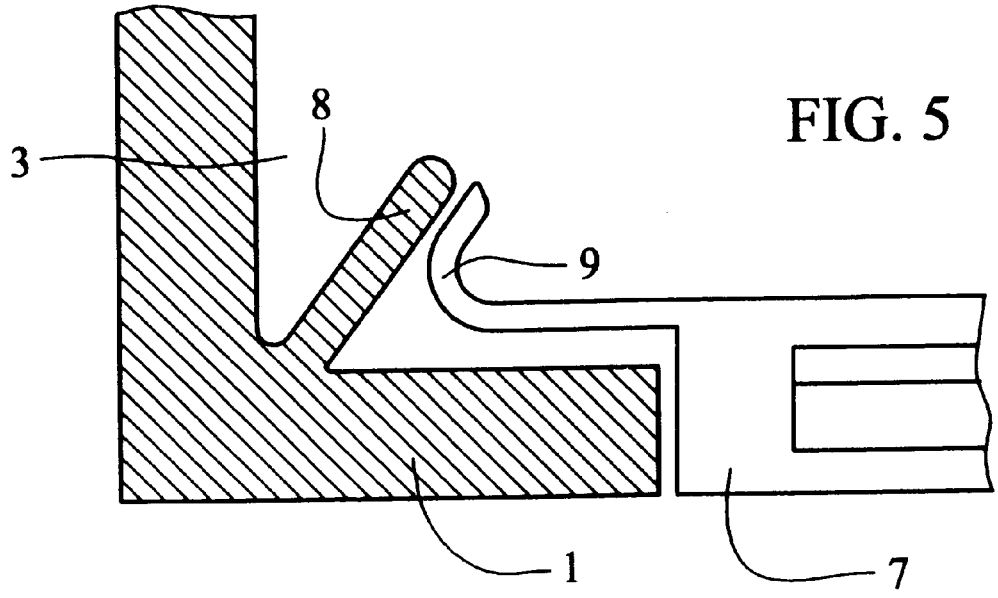
FIG. 5
FIG. 6
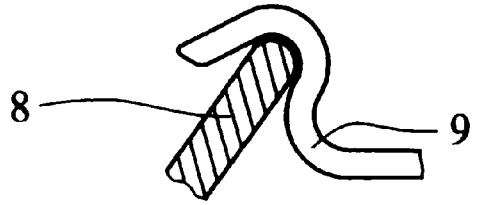
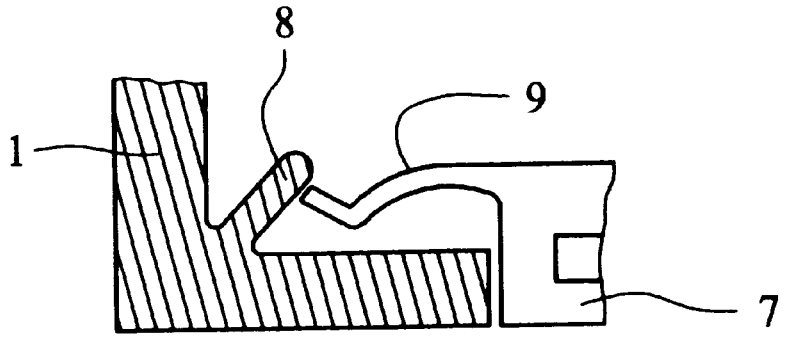
FIG. 7

MAKEUP BOX WITH A SOLID BOTTOM

This application corresponds to French application 98 09269 of Jul. 21, 1998, the disclosure of which is incorporated herein by reference.

The invention relates to a makeup box of the type comprising a bottom on which is articulated a cover, a push button being mounted in the periphery of the bottom opposite the swinging axis of the cover and coacting with a catch or the like on the cover.

In known makeup boxes, the bottom is covered at least partially with a platform cemented or welded to the bottom, adapted to receive makeup products. The bottom thus constituted has the risk of warpage or deformation constituting a serious flaw in the appearance of the piece.

The present invention seeks to overcome this drawback of known boxes.

To this end, the box according to the invention is characterized by the fact that the bottom is constituted by a solid piece provided with a recess running entirely about its internal periphery and opening centrally, a front window opening into said recess for the reception of a push button and catch means, such as ribs or tongues, for said push button, disposed on opposite sides of said window.

The monoblock solid bottom, provided with the peripheral internal recess, with the window and the hooking ribs or tongues, can be produced by injecting of a plastic material into a mold and by using a demolding technique over 360° permitting in particular the formation of the internal peripheral recess.

Such a piece, whose wall thickness can hardly vary, is not subject to warpage or deformations generally rising from abrupt variations of the thickness of the wall.

The invention will be better understood from a reading of the following description of an example of embodiment, with reference to the accompanying drawing, in which:

FIG. 1 is a schematic plan view of the bottom of the box,

FIG. 2 is a view in cross section on the line II—II of FIG. 1,

FIG. 3 is a cross-sectional view on the line III—III of FIG. 1, a push button being in place, FIG. 4 is a cross-sectional view on the line IV—IV of FIG. 1, and FIGS. 5 to 7 are schematic fragmentary views, similar to FIG. 4, of various modifications.

The bottom 1 of the box, of generally rectangular shape in the illustrated example, has a cutout for the articulation of a cover (not shown).

This bottom 1 comprises, according to the invention, opposite the cutout 2, an internal peripheral recess 3 running about 360° and opening toward the internal surface of the bottom through an opening 5 in a flange 4 which, in the illustrated example, is circular.

The bottom 1 comprises moreover a through window 6 in which is disposed a push button 7. Within the interior of the recess 3 are moreover disposed catches 8 for hooking to the push button 7, constituted for example by ribs or tongues disposed on opposite sides of the through window 6.

The push button 7 can comprise lateral prolongations 9 arranged to bend back in abutment against the catches comprising ribs or tongues 8 (FIG. 5), to hook about the free edges of the ribs or tongues 8 (FIG. 6) or to abut with their free end against the ribs or tongues 8 (FIG. 7).

Of course, any other mode of securement and holding of the push button 7 can be envisaged, as can also the shapes of the various portions.

What is claimed is:

1. In a makeup box comprising a bottom (1) on which is articulated a cover, a push button (7) mounted in the periphery of the bottom (1) opposite a swinging axis of the cover and coacting with a catch of the cover; the improvement wherein the bottom (1) is a solid piece provided with an upstanding peripheral wall surrounding a recess (3) extending about all the internal periphery of said solid piece and opening (5) centrally, a flange extending radially inwardly from an upper edge of said peripheral wall, said recess being defined between said bottom and peripheral wall and flange and opening radially inwardly of the bottom, a front window (6) opening into said recess (3) for the reception of a push button (7) and catches for said push button (7) disposed on opposite sides of said window (6).

2. A makeup box according to claim 1, wherein the catches (8) coact respectively by abutment with a prolongation (9) of the push button (7).

3. A makeup box according to claim 1, wherein the bottom (1) is molded from a single piece of synthetic material.

* * * * *